US008146181B2

(12) United States Patent
Gaus

(10) Patent No.: US 8,146,181 B2
(45) Date of Patent: Apr. 3, 2012

(54) DRAIN VALVE

(75) Inventor: Bruno Gaus, Offenburg (DE)

(73) Assignee: Meiko Maschinenbau GmbH & Co. KG, Offenburg (DE)

( * ) Notice: Subject to any disclaimer, the term of this patent is extended or adjusted under 35 U.S.C. 154(b) by 1074 days.

(21) Appl. No.: 12/028,125

(22) Filed: Feb. 8, 2008

(65) Prior Publication Data

US 2008/0190466 A1 Aug. 14, 2008

Related U.S. Application Data

(60) Provisional application No. 60/907,299, filed on Mar. 28, 2007.

(30) Foreign Application Priority Data

Feb. 9, 2007 (DE) ..... 10 2007 006 509

(51) Int. Cl.
*E03C 1/26* (2006.01)

(52) U.S. Cl. ..... 4/287; 137/550; 137/554; 4/668

(58) Field of Classification Search ..... 134/110, 134/111, 186; 137/544, 549, 550, 551, 554; 251/144, 248; 4/650, 652, 668, 679, 688, 4/689, 287, 288, 286

See application file for complete search history.

(56) References Cited

U.S. PATENT DOCUMENTS

| | | | | |
|---|---|---|---|---|
| 4,932,082 | A * | 6/1990 | Ridgeway | 4/287 |
| D357,306 | S * | 4/1995 | Lenox | D23/260 |
| 5,592,701 | A * | 1/1997 | Smith | 4/295 |
| 6,032,924 | A * | 3/2000 | Castle | 251/129.12 |
| 7,129,832 | B2 * | 10/2006 | Sabatino | 340/511 |
| 2004/0255378 | A1 * | 12/2004 | Tracy | 4/689 |
| 2006/0195976 | A1 * | 9/2006 | McAlpine | 4/287 |

* cited by examiner

*Primary Examiner* — John Rivell
*Assistant Examiner* — R. K. Arundale
(74) *Attorney, Agent, or Firm* — Ronald E. Greigg

(57) ABSTRACT

A drain valve which is used in particular in storage tanks of dishwashers, such as single-chamber or multi-chamber dishwashers. The drain valve comprises a sieve insert accommodated on a support which is of tubular design, and in which a contact switch is arranged to sense the presence of the sieve insert. The support can be moved in the vertical direction with respect to the drain opening in the base of a storage tank by means of an electric drive.

17 Claims, 1 Drawing Sheet

DRAIN VALVE

CROSS REFERENCE TO RELATED APPLICATIONS

This application is based on German Patent Application No. 10 2007 006 509.6 filed 9 Feb. 2007, upon which priority is claimed, and on Provisional Application 60/907,299 filed on Mar. 28, 2007.

BACKGROUND OF THE INVENTION

1. Field of the Invention

This invention relates to an improved drain valve useful for opening and closing a drain opening in a storage vessel such as a drain opening in a dishwasher.

2. Description of the Prior Art

DE 1688 818 discloses a drain valve which can be used for closing or opening the drain of wash basins, bath tubs and the like or else of shower trays, and comprises a sleeve which is fastened to a central spindle and is held in the outflow cross section of the valve, and also a fixable cone valve. A shell is arranged on the spindle which bears the valve cone, which shell is provided with passage openings in the manner of a sieve, has an enlarged diameter in relation to the valve cone and extends virtually as far as the wall of the tub/tray part of the valve stem. The shell-shaped part is formed directly on the valve cone with an edge which extends in a curved manner toward the tub/tray opening of the valve. This edge part is provided with a number of holes and, in the closed state of the valve, is located directly above a preferably rounded valve stem shoulder surface provided above the valve seat surface.

DE 690 00 863 T2 discloses a cup-shaped sieve for a drain valve with remote actuation. An outlet drain stopper with a sieve is disclosed, the sieve serving to catch small particles entering into a drain pipe through an inlet. The sieve comprises an annular element which is operatively connected in a tight-fitting and freely sliding manner to the wall of the drain pipe. Furthermore, the sieve comprises a disk-shaped horizontal base wall with a multiplicity of relatively small openings. Water can drain through the latter out of the sieve without small objects held back by said sieve becoming lost. The horizontal base wall is produced from resilient material and has a multiplicity of interconnected slots running radially. The multiplicity of slots define a multiplicity of gripping flaps which are spread open when the center with respect to the horizontal base wall slides over the base of the drain stopper and on the shaft. The gripping flaps are deformed downward, and therefore they enter into engagement with the shaft tightly and resiliently, as a result of which the annular element is oriented during use while the sieve is secured against a movement along the drain pin.

SUMMARY OF THE INVENTION

The present invention is directed to a drain valve for an automatic cleaning machine, the operability of the drain valve being able to be determined via the machine control system.

According to the invention, the drain valve is arranged in the tank base of a storage tank of a conveyor-type dishwasher. This storage tank may be a tank in which either washing water or pump-operated final-rinsing water is stored. The drain valves are generally located in the tank base of said tanks and are actuated if the respective treatment medium of the respective treatment zone, in particular of a conveyor-type dishwasher, has to be exchanged because, for example, its degree of soiling has become too high.

The drain valve proposed according to the invention comprises a sieve insert manufactured, for example, as an injection-molded plastic part. The sieve insert comprises a sieve base which is designed with a closed base surface, and a sieve wall surrounding the sieve base. A number of openings which run essentially vertically and are preferably in the form of slots are formed in the sieve wall, and therefore the treatment medium containing impurities which pass to the sieve insert from above can flow though the number of openings formed in the sieve wall in the direction of an outlet pipe. The sieve insert of the drain valve is dimensioned in such a manner that all impurities, such as, for example, serviette residues, food residues, toothpicks or the like, which cannot pass through the drain pipe, i.e. would tend to clog up the cross section of the drain pipe, are held back. On the other hand, anything which can pass through the drain pipe can pass through the drain valve proposed according to the invention.

Following the solution proposed according to the invention, the drain valve comprises a plunger, on the upper end side of which the sieve insert is mounted. A contact switch which is preferably designed as a reed contact switch is located within the drain valve plunger which supports the sieve insert. As soon as the sieve insert of the drain valve is fitted on the corresponding end surface of the plunger, the reed contact switch recognizes this fact and transmits a corresponding signal to the machine control system of the conveyor-type dishwasher. If a reed switch is assigned to each of the storage tanks of the various treatment zones of a conveyor-type dishwasher, it can be recognized via the machine control system whether the drain valves in the respective storage tanks of the conveyor-type dishwasher are operative, i.e. whether the sieve insert is present or not. Furthermore, it can be recognized via the machine control system whether the sieve insert has been removed from the machine for daily cleaning and has been re-inserted.

The contact switch recognizes whether the drain valve has the sieve insert or whether the latter is missing. Furthermore, the drain valve which is proposed according to the invention and which can be used in particular on automatic conveyor-type dishwashers or single-chamber dishwashers or the like has an electric drive. For this purpose, the sieve insert can be moved in the vertical direction via a sleeve arrangement. The plunger in which the contact switch is accommodated, is surrounded by a sleeve. The plunger has a rack section extending essentially in the vertical direction. The rack section is driven via a pinion of an electric drive such that the plunger can be moved in the vertical direction. Since the sleeve accommodates the plunger on which the sieve insert is accommodated, a vertical movement of the plunger also moves the sieve insert vertically. As a result, a drain opening located within the drain valve is either closed or opened up by the sieve insert base, which is of closed design.

BRIEF DESCRIPTION OF THE DRAWINGS

The invention is described in more detail below with reference to the drawing, in which.

DESCRIPTION OF THE PREFERRED EMBODIMENTS

Figure 1:
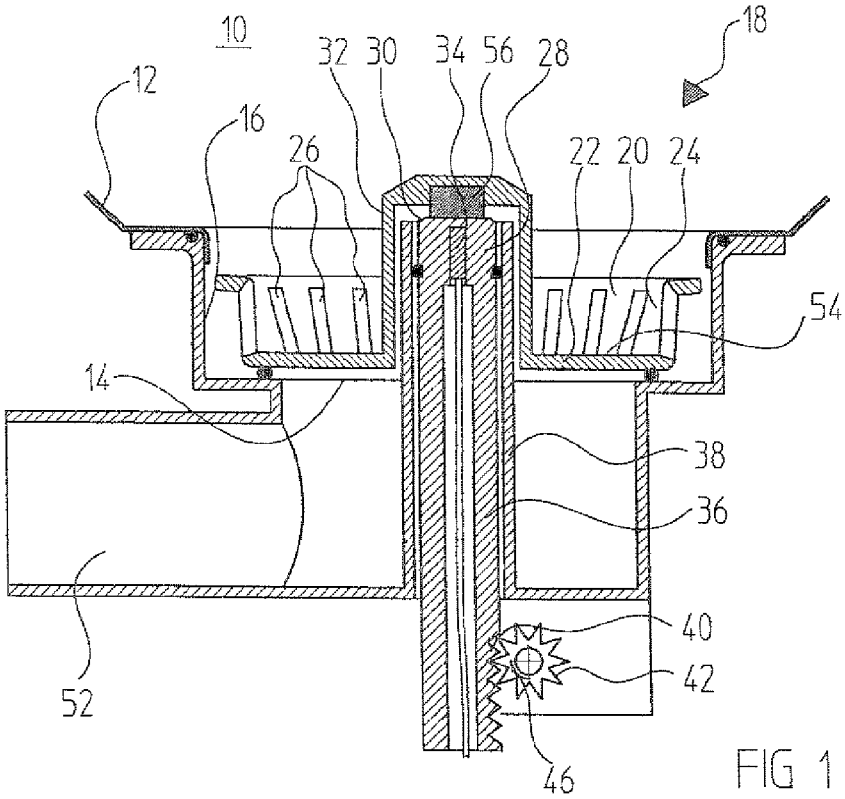
FIG. 1 shows a section through the closed, electrically operated drain valve according to the invention and which is monitored by means of a contact switch.

The illustration according to FIG. 1 reveals a preferred embodiment of the drain valve according to the invention and which is driven electrically, with the presence of a sieve insert being monitored by means of a contact switch.

A drain valve 18 which is illustrated in section in FIG. 1 is accommodated in the tank base 12 of a storage tank 10. The storage tank 10 is, in particular, a storage tank 10 accommodating treatment medium which comprises washing water, fresh water, pump-operated final-rinsing water or the like. Tanks of this type are arranged in single-chamber or multi-chamber dishwashers and accommodate the washing water which is recirculated in various treatment zones, for example of a conveyor-type dishwasher. In the tank base 12 of the storage tan 10 there is a drain opening 14 which is bounded by a wall 16 and which can be closed or opened by valve 18 by means of the sieve insert 20 having a closed base 22.

The drain valve 18 according to the illustration in FIG. 1 comprises the sieve insert 20 which has a base 22 surrounded by a sieve wall 24 arranged essentially perpendicularly with respect to the base. A number of openings 26 are formed in the sieve wall 24, the openings preferably being designed as slots extending generally in the vertical direction. With such a pattern of openings in the sieve wall 24 of the sieve insert 20, a multiplicity of particles such as food particles contained in the recirculated washing water can be held back.

The sieve insert 20 which is illustrated in section in FIG. 1 is preferably manufactured as an injection-molded plastic component. A plunger 28, the tube wall of which is identified by reference number 36, comprises a rest 30 on which the sieve insert 20 is accommodated by means of the inside of a gripping piece 32 and is positioned in the vertical direction. A contact switch 34 is located in the interior of the cavity of the plunger 28, which cavity is bounded by the tube wall 36. The contact switch 34 in the interior of plunger 28 is preferably designed as a reed contact and is connected to a machine control system (not illustrated in FIG. 1) of a conveyor-type dishwasher or other cleaning apparatus. The contact switch 34 is switched by means of an activator 56 which is designed, for example, as a magnet and which is located on the sieve insert 20. It is conceivable, as illustrated in FIG. 1, that the contact switch 34 is a reed switch and the latter is switched by a magnet 56 which is fitted fixedly at the upper end of the sieve insert 20. A further possibility for the design of the contact switch 34 is the use of a Hall sensor.

As is furthermore revealed from the sectional illustration according to FIG. 1, the plunger 28 is surrounded by a sleeve 38 on which the sieve insert 20 is guided in the axial direction by means of the inside of the gripping piece 32. The plunger 28 is likewise guided in the axial direction by means of the sleeve 38. Furthermore, the plunger 28 comprises a toothed section 40 forming a rack with which a pinion 42, which is driven in the direction of rotation 46 by an electric drive (not illustrated in FIG. 1), meshes. Since the toothed section 40 and the pinion 42 mesh with each other, during driving of the pinion 42 a sieve insert 20 is moved vertically upward or downward, depending on the direction of rotation indicated by arrow 46, since the movement of the sleeve 38 upward in the vertical direction causes the plunger 28 to raise the sieve insert 20 from the drain opening 14 via the rest 30 or to lower it thereon. If the sieve insert 20, as illustrated in FIG. 2, is raised by a lifting distance 44, washing water flows through the drain opening 14 to the drain pipe 52.

Figure 2:
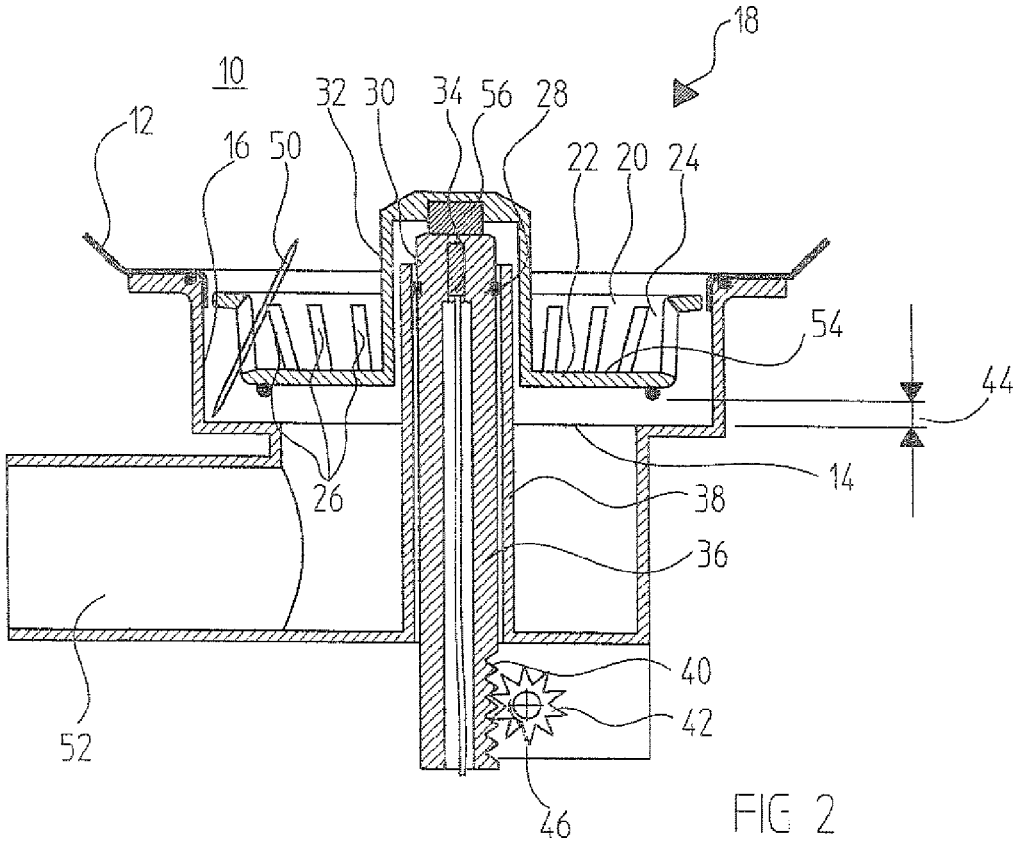
FIG. 2 shows a section through the open, electrically operated drain valve according to the invention and having an object held back by the integrated sieve.

The illustration according to FIG. 2 reveals that an elongate object in the form of a toothpick 50 has been caught in one of the openings 26, with an essentially slot-shaped profile, in the sieve wall 24 of the sieve insert 20. The toothpick is not capable of entering the flow cross section of the drain pipe 52, since it is held back by the sieve insert 20. The configuration of the sieve insert 20 with a closed base surface 22 and with the sieve wall 24 which has a multiplicity of openings 26 running essentially vertically and in the form of slots, enables only particles which can readily pass through the drain pipe, i.e. particles which do not clog up the drain pipe 52, to enter the latter. All foreign bodies which cannot reliably pass through the drain pipe are held back in the sieve insert 20—as indicated in FIG. 2—which is simple to remove manually. The sieve insert 20 is very easily accessible and, by simple grasping of the same by way of the gripping piece 32, can be taken out of the drain valve 18, briefly rinsed out and then re-inserted into the drain valve 18. The base 22, which is designed as a closed surface 54, of the sieve insert 20 firstly forms the valve disk of the drain valve 18, which valve disk closes the drain opening 14 formed in the tank base 12, and secondly forms a catching surface for foreign bodies held back in the sieve insert 20, whether—as indicated in FIG. 2—a toothpick 50, serviette residues, food residues or other foreign bodies.

It can furthermore be gathered from the illustration according to FIG. 2 that the sieve insert 20 of the drain valve 18 rests on the rest 30 at the upper end of the plunger 28, in the cavity of which, which is bounded by the tube wall 36, is arranged the contact switch 34, which is preferably a reed contact switch with which the presence or the absence of the sieve insert 20 at the drain valve 18 is recognized.

As illustrated in FIG. 2, the drain valve 18 is located in particular in a depression in the tank base 12. The drain opening 14, from which the drain pipe 52 leads in the direction of the waste water conduit, is located in the base of the drain valve 18. When the drain valve 18 is open, i.e. when the base 22 with the closed surface is raised from the drain opening 14 by the lifting distance 44, as illustrated in FIG. 2, waste water flows out of the storage tank 10 through the drain pipe 52 in the direction of the waste water conduit.

It can be gathered from the illustration according to FIG. 2 that the sieve insert 20 can be grasped by way of the gripping piece 32 and can be raised from the rest 30 on the plunger 28 in an extremely simple manner. Foreign bodies located on the base 22 with the closed surface can be disposed of outside the storage tank 10. The sieve insert 20 is subsequently placed again onto the rest 30 of the drain valve 18. The presence of the sieve insert 20 is recognized by the contact switch 34, which is preferably a reed contact or a Hall sensor in conjunction with an activator 56, and announced to the machine control system. With this concept all of the storage tanks can be monitored to the effect of whether the drain valves are operative, i.e. their respective sieve inserts 20 are placed on the rests 30 on the plunger 28 whether they are missing.

Furthermore, the solution proposed according to the invention provides the possibility of electrically activating the drain valves 18. The solution illustrated in the respective sectional illustrates in FIGS. 1 and 2 and comprising the sleeve 38, the toothed section 40 and the pinion 42 serves for this purpose.

FIGS. 1 and 2 reveal that the sieve wall 24 of the sieve insert 20 has a continuous sequence in the circumferential direction of openings 26 essentially designed in the form of slots.

The foregoing relates to the preferred exemplary embodiment of the invention it being understood that other variants and embodiments thereof are possible within the spirit and scope of the invention, the latter being defined by the appended claims.

The invention claimed is:

1. A drain valve for closing or opening a drain opening in a storage tank of a dishwasher, the drain valve comprising a support member mounted for vertical movement through a lifting distance to open and close the valve, a sieve insert supported on the support member, and a contact switch on the support member for sensing a presence of the sieve on the support member, wherein the sieve insert comprises a base embodied as a closed surface and serving as a valve disk.

2. The drain valve as claimed in claim 1, wherein the sieve insert comprises a sieve wall which has a number of generally parallel, slot-shaped openings spaced from one another in a circumferential direction.

3. The drain valve as claimed in claim 1, wherein the support comprises a rest on which the sieve insert rests.

4. The drain valve as claimed in claim 1, wherein the contact switch is a reed contact.

5. The drain valve as claimed in claim 1, wherein the contact switch is a Hall sensor.

6. The drain valve as claimed in claim 1, wherein the support is an essentially hollow tubular plunger which accommodates the contact switch in its hollow interior.

7. The drain valve as claimed in claim 1, wherein the support has at least one toothed section which meshes with a pinion of an electric drive.

8. The drain valve as claimed in claim 2, wherein the support has at least one toothed section which meshes with a pinion of an electric drive.

9. The drain valve as claimed in claim 3, wherein the support has at least one toothed section which meshes with a pinion of an electric drive.

10. The drain valve as claimed in claim 4, wherein the support has at least one toothed section which meshes with a pinion of an electric drive.

11. The drain valve as claimed in claim 5, wherein the support has at least one toothed section which meshes with a pinion of an electric drive.

12. The drain valve as claimed in claim 6, wherein the support has at least one toothed section which meshes with a pinion of an electric drive.

13. The drain valve as claimed in claim 1, wherein the sieve insert comprises a gripping piece.

14. The drain valve as claimed in claim 2, wherein the sieve insert comprises a gripping piece.

15. The drain valve as claimed in claim 3, wherein the sieve insert comprises a gripping piece.

16. The drain valve as claimed in claim 4, wherein the sieve insert comprises a gripping piece.

17. The drain valve as claimed in claim 5, wherein the sieve insert comprises a gripping piece.

* * * * *